United States Patent [19]

Henderson

[11] 4,179,144

[45] Dec. 18, 1979

[54] REMOVABLE COVER AND HOLDER THEREFOR

[76] Inventor: Donald L. Henderson, 2536 E. 56th Pl., Tulsa, Okla. 74105

[21] Appl. No.: 853,220

[22] Filed: Nov. 21, 1977

[51] Int. Cl.[2] ..... E05C 3/04

[52] U.S. Cl. ..... 292/202

[58] Field of Search ..... 292/DIG. 38, DIG. 53, 292/DIG. 6, 202, 204, 209, 241, 242, 240; 24/221

[56] References Cited

U.S. PATENT DOCUMENTS

| | | | |
|---|---|---|---|
| 1,535,226 | 4/1925 | Jackson | 292/204 X |
| 2,184,674 | 12/1939 | Jorgensen | 292/204 X |
| 2,196,478 | 4/1940 | Simpson | 292/DIG. 6 |
| 3,514,820 | 6/1970 | Rogg | 24/221 R |
| 3,715,531 | 2/1973 | Keeley | 292/202 |
| 3,764,729 | 10/1973 | Kawolewski | 24/221 R |

*Primary Examiner*—Richard E. Moore

*Attorney, Agent, or Firm*—Head & Johnson

[57] ABSTRACT

A device for supporting a removable panel such as an insulating cover from an attic fan opening, the device consisting of a longitudinal hollow boss member adapted to be affixed to the wall adjacent the opening, the boss member having an integral leg portion for receiving a screw of the like by means of which the boss member is held to the wall, and an arm member pivotally affixed at the inner end to the boss member, the arm pivotal to extend parallel the boss member leg portion to engage and hold a panel in place, and pivotal in the opposite direction to enable the panel to be removed.

4 Claims, 10 Drawing Figures

REMOVABLE COVER AND HOLDER THEREFOR

BACKGROUND AND OBJECTS OF THE INVENTION

While the device of this invention has many applications, it is particularly useful, and will be described, as it relates to holding an attic fan cover in place. Many homes have attic fans which are usually mounted in the ceiling of a hallway. The attic fan typically has louvers which fold down when the attic fan is not in operation and which are pulled upwardly to allow passage of air therethrough when the fan is energized. The louvers are not airtight, and since they are usually made of thin metal, such as aluminum, are very good conductors of heat. Therefore, during winter months, much heat is lost through attic fan louvers even if they fit perfectly together and, in most instances, air is free to pass through the louvers, which results in even greater heat loss.

The present invention is directed towards a device which can be used in conjunction with a panel, such as sheets of styrofoam approximately ¾ or 1" thick, which can be placed over the attic fan louver to seal the louvers against passage of air therethrough, and further, to serve as insulation to reduce the amount of heat loss occurring through the attic fan louvers.

The device of this invention is composed of two portions which are secured together in a pivotal arrangement. Each of the portions are integrally cast or molded devices of metal or plastic, but plastic is preferred because of its economy. The elements are specifically designed to be snapped into interlocking relation without the use of screws or other fastening means so as to provide a two-piece device for attachment to a wall adjacent an opening and particularly, for attachment to a wall by means of a frame which is integral with attic fan louvers so as to easily facilitate the placement or removal of an attic fan cover.

It is therefore an object of this invention to provide an improved device for supporting a removable panel over an opening in a wall.

More particularly, an object of this invention is to provide a device formed of two mated elements which are adaptable to be mounted adjacent an opening in a wall to removably support a panel over the opening.

These general objects as well as other and more specific objects of the invention will be fulfilled in the following description and claims, taken in conjunction with the attached drawings.

DESCRIPTION OF VIEWS

SUMMARY OF THE INVENTION

A device is provided particularly adaptable for holding a cover for an attic fan in position. The device consists of two molded elements, either of metal or of plastic, the elements being snapped together to form a unified member, the elements forming the member being a boss member having a leg with an opening therethrough providing means for attachment of the boss member to a screw for holding the boss member in position relative to an attic fan louver, and the other portion of the device being a pivoted arm member extending from the boss member and pivotable in one way to allow an attic fan cover, such as a sheet of styrofoam, to be positioned against the louver and pivoted in another way to extend to engage one surface of the panel to hold the panel in position. A plurality of the devices are employed around an attic fan louver to removably hold the panel in position.

DETAILED DESCRIPTION OF THE PREFERRED EMBODIMENT

Figure 1:
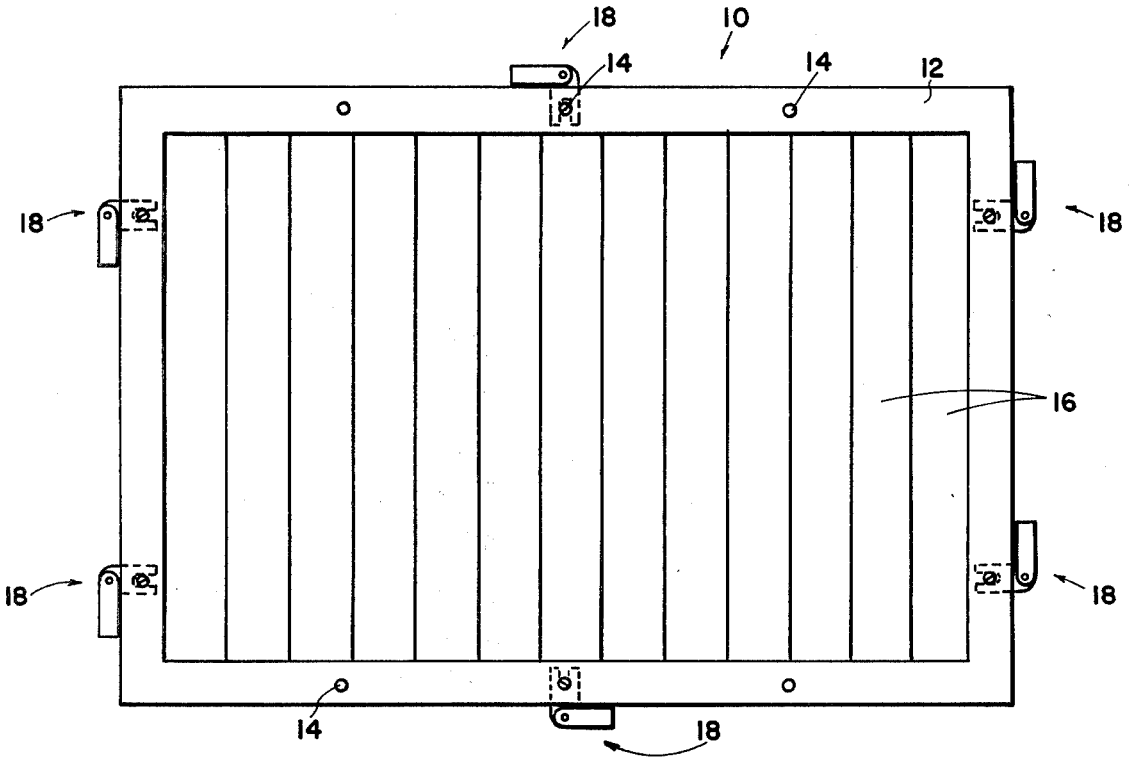
FIG. 1 is a view of a typical louver as employed with an attic fan, the view looking up to the louver and showing six of the devices of this invention as employed for removably supporting a panel over the louver.

Referring to the drawing and first to FIG. 1, a view is shown looking up to an attic fan louver and showing six of the devices of this invention for use in removably supporting a panel to cover the louver. The attic fan louver is indicated generally by the numeral 10, the louver having a frame 12 which extends around the total circumference of the louver. The frame 12 is mounted in an opening in the ceiling in which the attic fan is positioned and the frame is held in place by means of screws 14 spaced at intervals around the frame. The attic fan louver 10 is of the type having a plurality of pivoted louver blades 16 which swing downwardly into a common plane as illustrated to close the opening and which pivot 90° upwardly to allow air to pass therethrough. Most attic fan louvers do not provide perfect closure, and air passages exist between the louvers and, in addition, since the louver blades 16 are usually formed of thin metal, typically aluminum, very poor insulation is provided for preventing the escape of heat.

FIG. 1 shows six of the devices of this invention which are used to removably support a panel to cover the attic fan louver 10, the devices being indicated generally by the numeral 18. These devices 18 will be described in detail subsequently.

Figure 2:
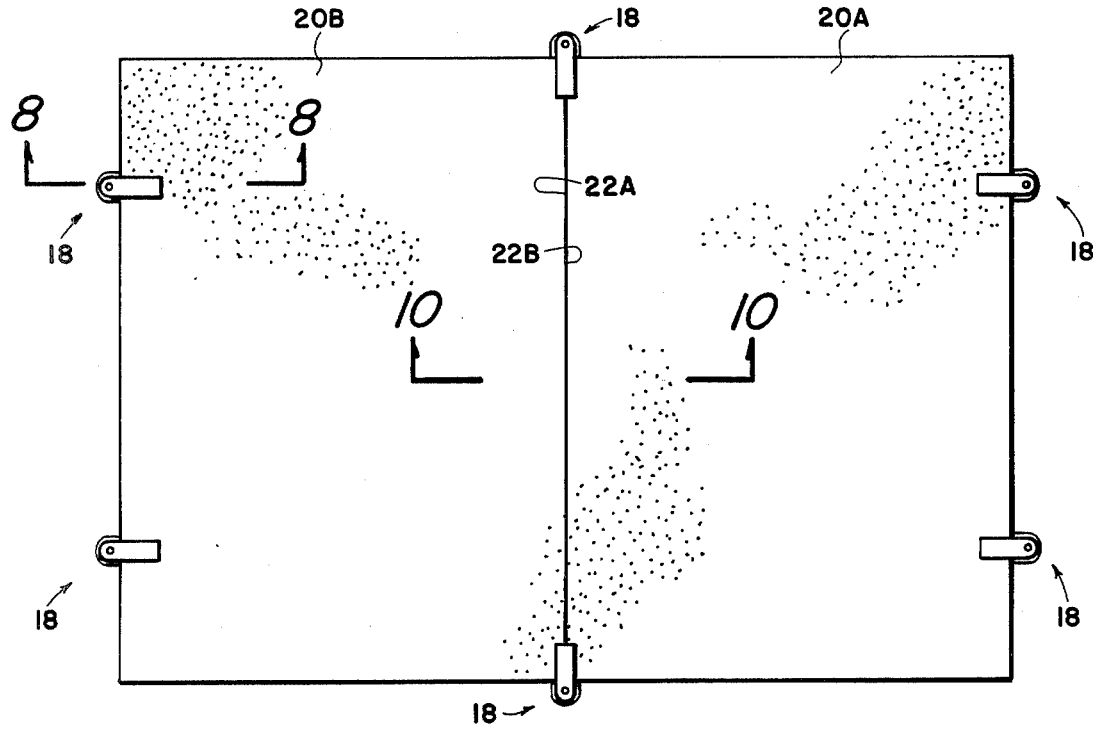
FIG. 2 is a view as in FIG. 1, but showing a panel, such as formed of two sheets of styrofoam, positioned over the louver and held in place by the devices of this invention.
Figure 10:
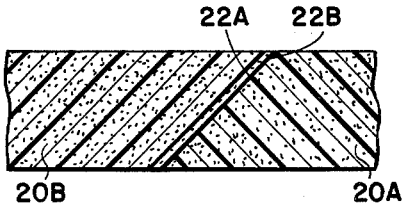
FIG. 10 is a fragmentary cross-sectional view taken along the line 10—10 of FIG. 2 showing the arrangement of the edges of the panels.

FIG. 2 shows the placement of panels 20A and 20B against the louver so as to close it against the passage of air therethrough and to provide insulation. The panels are preferably of cellular plastic, such as styrofoam. This material is preferred because it is lightweight, inexpensive, has excellent insulating qualities, and is impervious to the passage of air therethrough. The panel could be one piece but preferably is of two pieces indicated by numeral 20A and 20B, with the edges 22A and 22B tapered at a 45° angle as shown in FIG. 10. Most attic fan louvers 10 are fairly large, and it is difficult to handle a single sheet of material to cover them. By dividing the panel into portions 20A and 20B, and providing the inclined edges 22A and 22B, the home owner can easily install the panel to cover the louvers, and the tapered edges 22A and 22B insure better air-tight joinder of the panels.

In FIG. 2 the members 18 are oriented so as to hold the panels 20A and 20B in position.

FIGS. 1 and 2 are primarily illustrative of the application of the device of this invention, and the device itself will now be described in detail.

Figure 4:
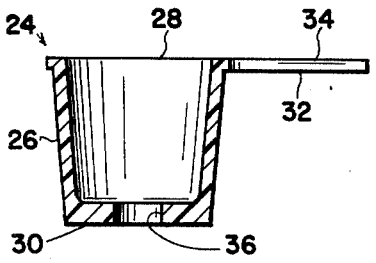
FIG. 4 is a cross-sectional view of the boss member taken along the line 4—4 of FIG. 3.
Figure 3:
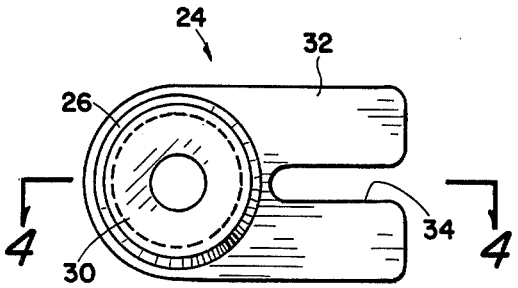
FIG. 3 is a bottom view of the boss member of the device of the invention.

The device consists of two molded or cast elements, the first being a boss member generally indicated by numeral 24 and illustrated in FIGS. 3 and 4. The boss member is a longitudinal hollow member and the main body portion 26 is shown to be of frusto-conical configuration, although it could equally as well be cylindrical, or of square cross-sectional configuration. The body portion 26 has an upper end 28 and a lower end 30. Integrally extending from the upper end 28 is a foot portion 32 which has a slot 34 therein. The foot portion 32 serves as a means of attachment of the boss member 24 to a wall or ceiling adjacent an opening to be closed. Slot 34 could be in the form of an opening to receive a screw or other means of holding the device to a wall. Slot 34 is preferred since it may be slid underneath an attic fan louver frame to receive a screw in a manner to be described subsequently.

The boss member 24 has the lower end 30 closed and has an axial small diameter opening 36 therein.

Figure 5:
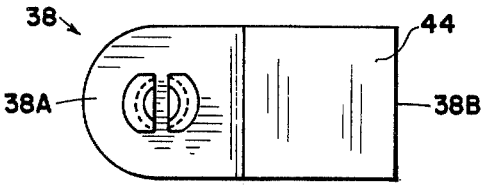
FIG. 5 is a plan view of the arm member of the device of this invention.
Figure 6:
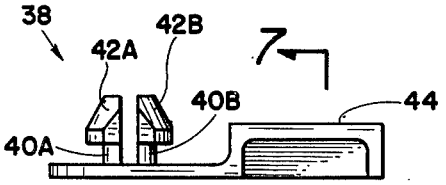
FIG. 6 is an elevational view of the arm member portion.
Figure 7:
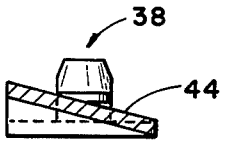
FIG. 7 is a cross-sectional view of the outer end of the arm member as taken along the line 7—7 of FIG. 6.

The second element of the device of this invention is an arm member illustrated in FIGS. 5, 6, and 7. The arm member is generally indicated by the numeral 38 and is shown in the plan view in FIG. 5. The arm member is elongated, having an inner end 38A and outer end 38B. At the inner end 38A a means is provided for pivotally attaching the arm to the boss member, the pivot means being formed by two integrally extending portions 40A and 40B. The pivot portion is bifurcated; that is, the portions 40A and 40B are spaced slightly apart from each other. The outer end 42A and 42B of the pivot portion is of enlarged diameter and of a diameter which, in its natural state, is larger than the diameter of opening 36 in the boss member 24. To assemble the arm member 38 to the boss member 24, the pivot portion outer ends 42A and 42B are forced through opening 36. After passing through the opening they expand apart from each other, and the enlarged diameter outer ends 42A and 42B retain the arm member 38 in pivotal relationship to the boss member 24 as illustrated in FIG. 9.

Referring further to FIGS. 5, 6, and 7, the outer end 38B of the arm member is wedge-shaped, providing an inclined planar surface 44, the surface 44 being inclined in an angle to the plane of the arm member. The inclined surface of the wedge-shaped outer end 38B facilitates pivotation of the outer end of the arm over a panel when pivoting the arm to hold a panel in position.

Figure 8:
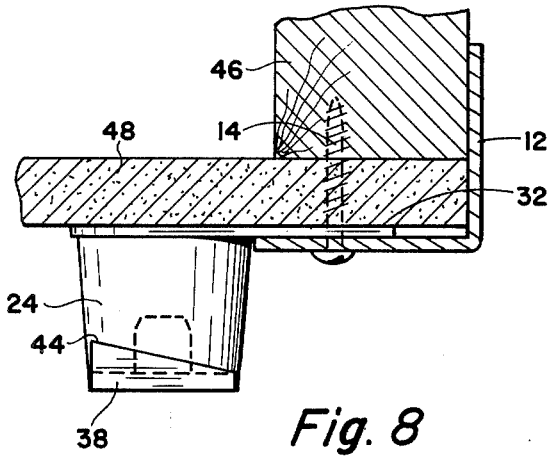
FIG. 8 is a cross-sectional view of a portion of a ceiling having an opening therein receiving an attic fan louver and showing the device of this invention mounted for securing a cover for the louver, the device being shown in the open position wherein the cover may be inserted or removed.
Figure 9:
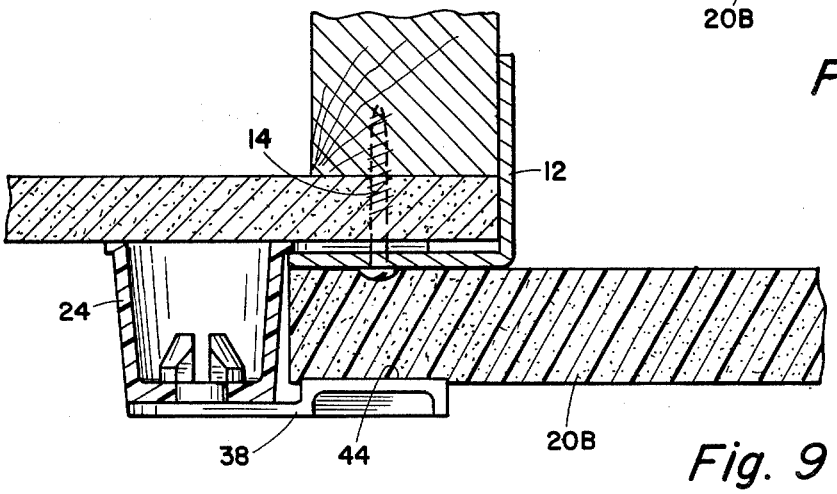
FIG. 9 is a cross-sectional view as shown in FIG. 8, but showing the arm member of the device pivoted in position to hold the cover in place.

FIGS. 8 and 9 show the application of the device of this invention. In FIG. 8 the frame 12 of an attic fan louver is shown mounted to the structural portions 46 of a building which supports a ceiling 48. Screw 14 retains the attic fan louver frame 12 in position. To employ the device of this invention, screw 14 is loosened sufficiently to permit the foot portion 32 of boss member 24 to slide under the frame 12 and preferably in a position so that the slot 34 of the foot portions receives screw 14. The screw 14 is then tightened, thereby securing the boss portion 24 to the building ceiling 48. The arm member 38 is pivoted so as not to extend over the frame 12. With a plurality of the devices positioned around frame 12, a panel may be positioned to cover the louver as shown in FIG. 9. The panel is, as previously stated, preferably of light cellular plastic material, such as styrofoam, of ¾ to 1" thick. The panel is positioned to cover the louver, and it may be manually pushed down around the edges so that the heads of screws 14 are slightly recessed in the panel and to secure a good air-tight engagement of the panel 20B with the attic fan louver frame 12. The arm members 38 are then pivoted so that the inclined surface 34 of the outer wedge-shaped end engages the lower surface of panel 20B to thereby hold the panel in position.

When it is desired to remove the panel, all that is necessary is to pivot the arm members back to the orientation as shown in FIG. 8. In this manner it can be seen that the panels may be easily placed or removed from over an attic fan. Normally the panels are removed in the summer months when the attic fan is used for cooling purposes and replaced during the winter months to prevent the loss of heat from the building when the attic fan is not in use.

While the invention has been particularly described as it relates to an attic fan cover, it can be seen that it can be used for any purpose where a removable cover is required for a wall or ceiling. The invention is not to be limited in any way due to the illustration of the embodiments set forth herein which have been for purposes of exemplification only. The invention is to be limited only by the scope of the attached claim or claims, including the full range of equivalency to which each element thereof is entitled.

What is claimed is:

1. A device for supporting a removable panel over an opening in a wall, comprising:

a longitudinal hollow boss member having a top end adapted to engage the wall and a bottom end, the boss member having a leg portion integrally extending therefrom at said wall engaging top end, the leg portion extending perpendicular the longitudinal axis of the boss member, the leg portion comprising a first portion and a parallel second portion, the two portions having their ends adjacent the boss member joined such that the leg portion is substantially in the shape of a "U"; said first and second portion spaced apart sufficiently that the leg portion may be slid under a screw head or the like whereby the boss member is attached to a wall adjacent an opening to be closed;

and an arm member having the inner end pivotally secured to the bottom end of said boss portion and extending in a plane parallel said boss leg portion, the outer end is configured of an integral wedge, the upper surface of which is in a plane inclined at an angle to the plane of the arm whereby when the arm is pivoted to engage a panel the wedge portion engages the panel to facilitate pivotation of the outer end of the arm over the panel.

2. A device for supporting a removable panel according to claim 1 wherein said boss member is hollow and wherein the bottom end is closed and has an opening therein, the axis of the opening being coincident with the boss member longitudinal axis, and wherein said arm has an integral pivot portion at said inner end configured to be received in said boss member opening to pivotally secure said arm to said boss member.

3. A device for supporting a removable panel according to claim 2 wherein said integral pivot member is defined by two juxtaposed portions having a space therebetween, and wherein the outer end of each portion of the pivot member is of enlarged diameter compared to the inner end affixed to said arm, the diameter of the juxtaposed outerend portions of the bifurcated pivot portion being greater than the diameter of the opening in the bottom end of the boss member, whereby the enlarged outer end of the pivot member may be forced through said boss member opening to pivotally retain the arm to the boss member.

4. A device for supporting a removable panel according to claim 1 wherein said opening in said boss member leg portion is in the form of a slot whereby the leg portion may be slid under a screw head or the like.

* * * * *